US011255564B2

(12) United States Patent
Shimamura

(10) Patent No.: US 11,255,564 B2
(45) Date of Patent: Feb. 22, 2022

(54) AIR-CONDITIONER

(71) Applicant: FUJITSU GENERAL LIMITED, Kanagawa (JP)

(72) Inventor: Yutaka Shimamura, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 7 days.

(21) Appl. No.: 16/638,676

(22) PCT Filed: Oct. 12, 2018

(86) PCT No.: PCT/JP2018/038109
§ 371 (c)(1),
(2) Date: Feb. 12, 2020

(87) PCT Pub. No.: WO2019/078111
PCT Pub. Date: Apr. 25, 2019

(65) Prior Publication Data

US 2021/0190358 A1 Jun. 24, 2021

(30) Foreign Application Priority Data

Oct. 18, 2017 (JP) ..... JP2017-201528

(51) Int. Cl.
*F24F 11/61* (2018.01)
*F24F 11/58* (2018.01)
(Continued)

(52) U.S. Cl.
CPC ..... *F24F 11/58* (2018.01); *F24F 11/49* (2018.01); *F24F 11/61* (2018.01); *F24F 2110/10* (2018.01)

(58) Field of Classification Search
CPC ..... F24F 11/58; F24F 11/49; F24F 11/61
See application file for complete search history.

(56) References Cited

U.S. PATENT DOCUMENTS 8,594,850 B1 11/2013 Gourlay et al.
10,139,793 B2 11/2018 Yamada et al.
(Continued)

FOREIGN PATENT DOCUMENTS

CN 103917830 A 7/2014
CN 105674474 A 6/2016
(Continued)

OTHER PUBLICATIONS

Australian Office Action (AUOA) dated Nov. 19, 2020 issued in the corresponding Australian Patent Application No. 2018352399.
(Continued)

*Primary Examiner* — Mohammad Ali
*Assistant Examiner* — Vincent W Chang
(74) *Attorney, Agent, or Firm* — Rankin, Hill & Clark LLP

(57) ABSTRACT

Provided is a program update system for an air conditioner, which can complete update of a program without delay. A controller 51 determines whether it is summer or winter. If it is summer or winter, the controller 51 updates a communication program 52*a* to a downloaded update program. Or, the controller 51 determines whether a user has set timer on/off. If the user has set the timer on/off, the controller 51 updates the communication program 52*a* to the downloaded update program. Or, the controller 51 captures room temperature Ti and set temperature Tp, and determines whether a temperature difference ΔT calculated using the captured room temperature Ti and the set temperature Tp is greater than or equal to a threshold temperature difference Tth. If the temperature difference ΔT is greater than or equal to the threshold temperature difference Tth, the controller 51 updates the communication program 52*a* to the downloaded update program.

3 Claims, 3 Drawing Sheets

(51) Int. Cl.
*F24F 11/49* (2018.01)
*F24F 110/10* (2018.01)

(56) References Cited

U.S. PATENT DOCUMENTS

| | | | | |
|---|---|---|---|---|
| 10,605,474 | B2 * | 3/2020 | Malcolm | F24F 11/59 |
| 10,671,102 | B2 | 6/2020 | Kawai et al. | |
| 2003/0033392 | A1 | 2/2003 | Nakamura et al. | |
| 2009/0235244 | A1 | 9/2009 | Enomori et al. | |
| 2012/0093141 | A1 | 4/2012 | Imes et al. | |
| 2012/0158159 | A1 | 6/2012 | Kuroiwa et al. | |
| 2013/0132939 | A1 * | 5/2013 | Murata | H02J 7/04 717/173 |
| 2014/0058567 | A1 | 2/2014 | Matsuoka et al. | |
| 2014/0096126 | A1 * | 4/2014 | Gourlay | F24F 11/30 717/173 |
| 2014/0312130 | A1 | 10/2014 | Kawai et al. | |
| 2016/0161960 | A1 | 6/2016 | Yamada et al. | |
| 2017/0017482 | A1 * | 1/2017 | Yabe | G06F 8/65 |
| 2017/0038086 | A1 * | 2/2017 | Nabeshima | H04M 1/72415 |

FOREIGN PATENT DOCUMENTS

| | | | |
|---|---|---|---|
| EP | 1283397 | A2 | 2/2003 |
| EP | 2474791 | A1 | 7/2012 |
| JP | 2007-78221 | A | 3/2007 |
| JP | 2008-190853 | A | 8/2008 |
| JP | 2009-133549 | A | 6/2009 |
| JP | 2009-217656 | A | 9/2009 |
| JP | 2014-55739 | A | 3/2014 |
| JP | 2015-78770 | A | 4/2015 |
| JP | 2015-192306 | A | 11/2015 |

OTHER PUBLICATIONS

Chinese Office Action (CNOA) dated Nov. 3, 2020 for the corresponding Chinese Patent Application No. 201880051993.1.

International Search Report (ISR) dated Dec. 11, 2018 filed in PCT/JP2018/038109.

1st Office Action (OA) dated Dec. 4, 2018 for the corresponding Japanese Patent Application No. 2017-201528 and its English machine translation.

2nd Office Action (OA) dated Jun. 18, 2019 for the corresponding Japanese Patent Application No. 2017-201528 and its English machine translation.

Extended European Search Report (EESR) dated Jun. 14, 2021 for the corresponding European Patent Application No. 18868815.4.

* cited by examiner

AIR-CONDITIONER

TECHNICAL FIELD

The present invention relates to an air conditioner that can update various programs necessary for controlling the air conditioner.

BACKGROUND ART

Conventionally, the air conditioner is configured such that operations such as operation start and stop and setting of operation information such as an operation mode, a set temperature, an air volume, and a wind direction can be performed by a dedicated remote controller. In another proposed air conditioner, a device such as a smartphone or a tablet device (hereinafter referred to as an operation terminal) owned by a user is used instead of the remote controller. In order to operate the air conditioner by the operation terminal different from the remote controller, it is necessary to provide a communication adapter that mediates communication between the operation terminal and an indoor unit.

A program for performing communication between the operation terminal and the air conditioner is installed in the communication adapter described above. Then, the communication adapter operates according to the program. Thus, the operation terminal communicates with the air conditioner. Such a program is sometimes updated for the purpose of improving functions or eliminating a problem.

PATENT LITERATURE 1 proposes the air conditioner and the communication adapter that can automatically update the program. Specifically, the communication adapter is connected to a personal computer that can communicate with a computer (server) installed at a service center of a manufacturer of the air conditioner via the Internet. Then, an update control program (hereinafter referred to as an update program) of the air conditioner is uploaded to the computer. That is, the personal computer incorporates the update program, and the update program is downloaded to the communication adapter. Thus, the control program of the communication adapter is updated to the update program.

The communication adapter of PATENT LITERATURE 1 is a separate body from the indoor unit of the air conditioner. The communication adapter wirelessly communicates with the indoor unit. Operating power of the communication adapter is supplied from the personal computer. Further, the communication adapter described in PATENT LITERATURE 1 generally includes a display unit. With the supplied power, the display unit displays that the communication adapter is operating, the program is being updated, and the like. Thus, the user can recognize an operation state of the communication adapter.

CITATION LIST

Patent Literature

PATENT LITERATURE 1: JP-A-2009-133549

SUMMARY OF THE INVENTION

Problems to be Solved by the Invention

By the way, in recent years, there has been a demand for the above-described communication adapter which is stored inside the indoor unit and is supplied with the operating power from the indoor unit. When the communication adapter is supplied with the operating power from the indoor unit, power supply to the communication adapter is interrupted if the power supplied to the indoor unit is interrupted by, for example, pulling out a power plug of the indoor unit from an outlet or turning off a breaker by the user.

If the power supply to the communication adapter is interrupted during program update described above, the update program is not updated normally. As a result, when the operating power is supplied to the communication adapter again, the communication adapter may not operate. If the communication adapter has the display unit and the user can be notified by displaying that the program is being updated on the display unit, interruption of the power supply during the program update can be prevented. As a result, the program is updated without delay, so that a situation in which the communication adapter does not operate can be avoided.

However, when the communication adapter is stored inside the indoor unit, even if the communication adapter has the display unit, the display unit is invisible to the user. Therefore, the user cannot recognize the operation state of the communication adapter. Therefore, when the communication adapter is stored inside the indoor unit, the user may interrupt the power supply to the indoor unit during the program update. In this case, since the power supply to the communication adapter is also interrupted, there has been a possibility that the update program is not updated normally.

In view of the above circumstances, a purpose of the present invention is to provide the air conditioner that can complete the program update without delay.

Solution to the Problems

The present invention addresses the above-described problem, and an air conditioner according to the present invention includes a communication adapter configured to communicate with an external server through a communication network. The air conditioner includes a controller that stores in advance a program for controlling the air conditioner or the communication adapter. The controller is configured to download an update program of the program stored in advance from the external server, and determine a continuous power supply period in which supply of operating power to the air conditioner and the communication adapter is less likely to be interrupted, and further update the program stored in advance to the update program in the determined continuous power supply period.

Effects of the Invention

In the air conditioner of the present invention, the update to the update program is performed at a timing when the power supply is less likely to be interrupted by the user. Therefore, the update to the update program can be completed without delay.

DESCRIPTION OF THE EMBODIMENTS

Hereinafter, embodiments of the present invention will be described in detail with reference to the accompanying drawings. The embodiments will be described by taking the following air conditioner as an example. The air conditioner has an indoor unit and an outdoor unit connected by refrigerant pipes. A communication adapter is provided inside the indoor unit. Further, the indoor unit can be operated by an operation terminal other than a remote controller. Note that the present invention is not limited to the following embodiments. Various modifications can be made without departing from the gist of the present invention.

EXAMPLES

Figure 1:
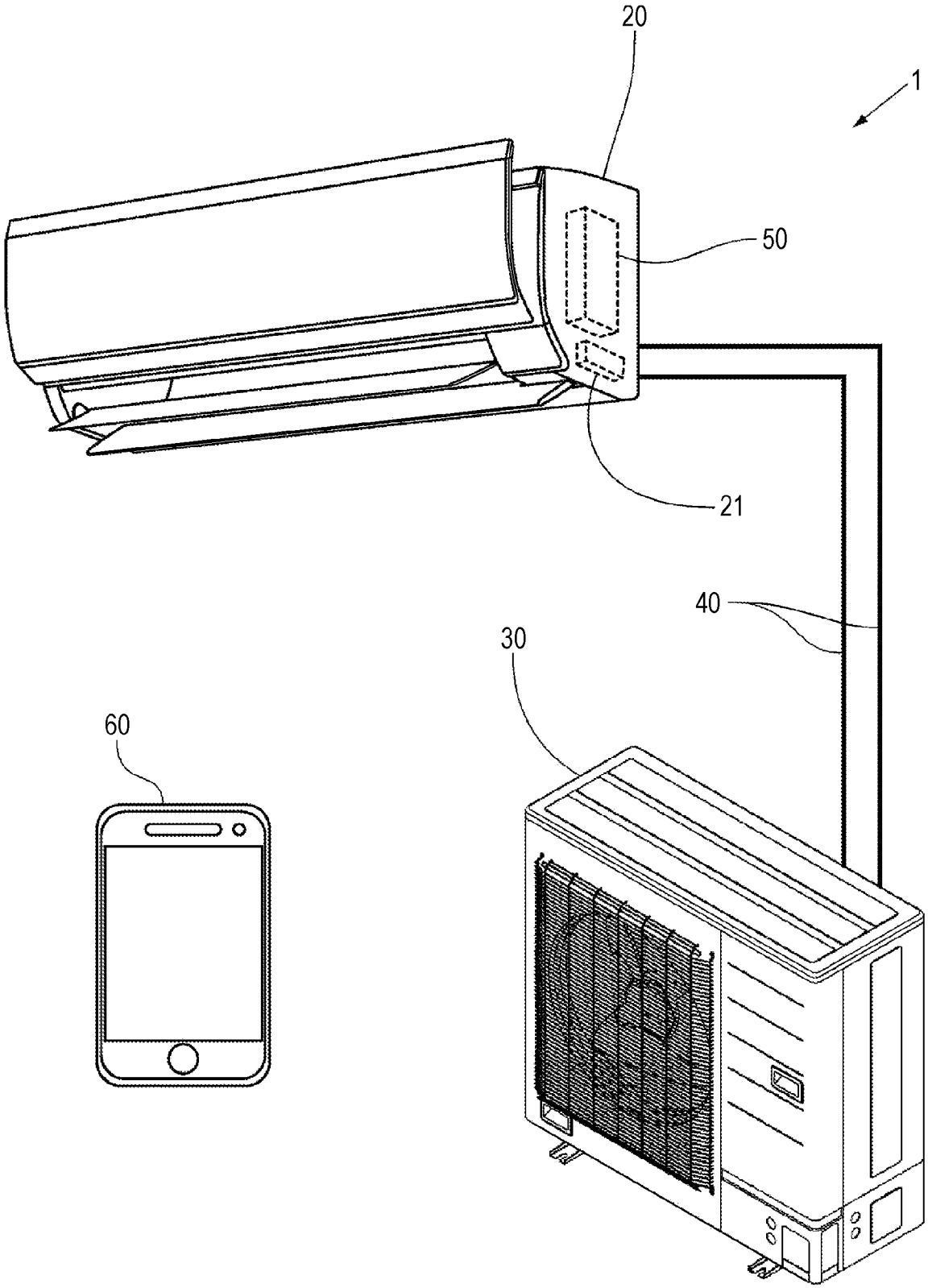
FIG. 1 is a schematic diagram of an air conditioner in an embodiment of the present invention.

First, a schematic configuration of an air conditioner 1 according to the present invention will be described. As shown in FIG. 1, the air conditioner 1 is placed indoors. The air conditioner 1 has an indoor unit 20 having a horizontally long substantially rectangular parallelepiped shape, and an outdoor unit 30 connected to the indoor unit 20 by two refrigerant pipes 40. The outdoor unit 30 is placed outdoors. When the air conditioner 1 starts operating, refrigerant circulates between the indoor unit 20 and the outdoor unit 30 through the refrigerant pipes 40. Then, in the indoor unit 20, indoor air is heated or cooled by the refrigerant. Thus, heating or cooling in a room is performed.

An indoor unit controller 21 and a communication adapter 50 are stored inside the indoor unit 20. The indoor unit controller 21 controls a rotation speed of a blowing fan provided in the indoor unit 20 and operation of a wind direction plate provided in an outlet. Further, the indoor unit controller 21 requests the outdoor unit 30 to have a capability required to set temperature of the room where the indoor unit 20 is installed to a set temperature requested by the user.

The communication adapter 50 mediates communication between the indoor unit 20 and an operation terminal 60 when the operation terminal 60 operates the indoor unit 20. Here, the operation terminal 60 is a terminal different from the remote controller (not shown) dedicated to the indoor unit 20. That is, the operation terminal 60 is a terminal that can communicate with the indoor unit 20 through the communication adapter 50, such as a smartphone or a tablet terminal owned by the user. Note that a dedicated application program for operating the indoor unit 20 is installed in the operation terminal 60.

Figure 2:
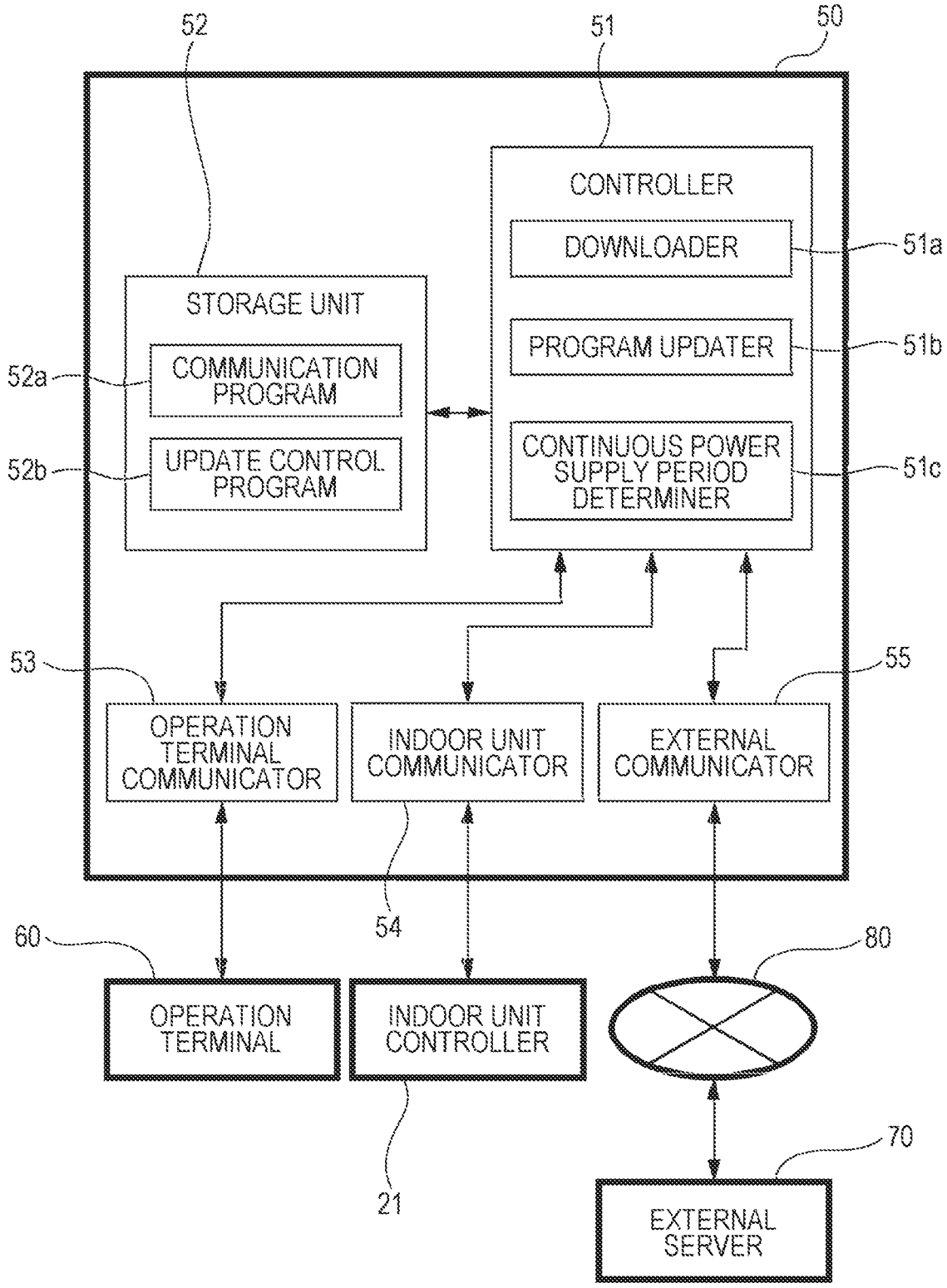
FIG. 2 is a configuration block diagram of a communication adapter in the embodiment of the present invention.

As illustrated in FIG. 2, the communication adapter 50 has a controller 51, a storage unit 52, an operation terminal communicator 53, an indoor unit communicator 54, and an external communicator 55. Note that the controller 51 of the communication adapter 50 and the indoor unit controller 21 of the indoor unit 20 constitute a controller of the present invention.

The storage unit 52 is constituted by, for example, a flash memory. The storage unit 52 stores a communication program 52*a* and an update control program 52*b* in advance. The communication program 52*a* is a program used when converting data related to operation information output from the operation terminal 60 into data that can be recognized by the indoor unit controller 21. Here, the operation information is information (hereinafter referred to as the operation information) on operation of the indoor unit 20 such as start and stop of the operation, switching of operation modes (cooling, heating, blowing and the like), change and switching of set temperature, air volume, and wind direction, and timer operation setting.

The update control program 52*b* is a program used when updating the communication program 52*a* described above to a new program. Specifically, the update control program 52*b* is used when an update program of the communication program 52*a* is downloaded from an external server 70 described below to a download area (not shown) of the storage unit 52. The update control program 52*b* is used when the communication program 52*a* is updated to the update program. Note that the communication program 52*a* is updated to the new program for the purpose of improving functions or eliminating a problem.

The operation terminal communicator 53 is an interface that communicates with the operation terminal 60. The indoor unit communicator 54 is an interface that communicates with the indoor unit controller 21. The external communicator 55 is an interface that communicates with the external server 70 through a communication network 80 such as the Internet. The external server 70 is, for example, a computer installed at a service center of a manufacturer of the air conditioner 1. Each time the communication program 52*a* is updated, the updated new communication program 52*a* is uploaded in the external server 70.

The controller 51 captures data related to the operation information output from the operation terminal 60 through the operation terminal communicator 53. The data related to the captured operation information is converted into data that can be recognized by the indoor unit controller 21 using the communication program 52*a* stored in the storage unit 51. Then, the controller 51 outputs the converted data to the indoor unit controller 21 through the indoor unit communicator 54.

The controller 51 includes a downloader 51*a*, a program updater 51*b*, and a continuous power supply period determiner 51*c*. The downloader 51*a* downloads the update program of the communication program 52*a* from the external server 70 through the network 80 using the update control program 52*b* stored in the storage unit 52, to store the update program in the storage unit 52. The program updater 51*b* updates the communication program 52*a* to the update program stored in the storage unit 52 using the update control program 52*b*. The continuous power supply period determiner 51*c* determines whether it is the continuous power supply period in which supply of operating power to the air conditioner 1 and the communication adapter 50 is less likely to be interrupted, using calendar information described below, timer on/off setting, and temperature difference ΔT between room temperature Ti and set temperature Tp.

Figure 3:
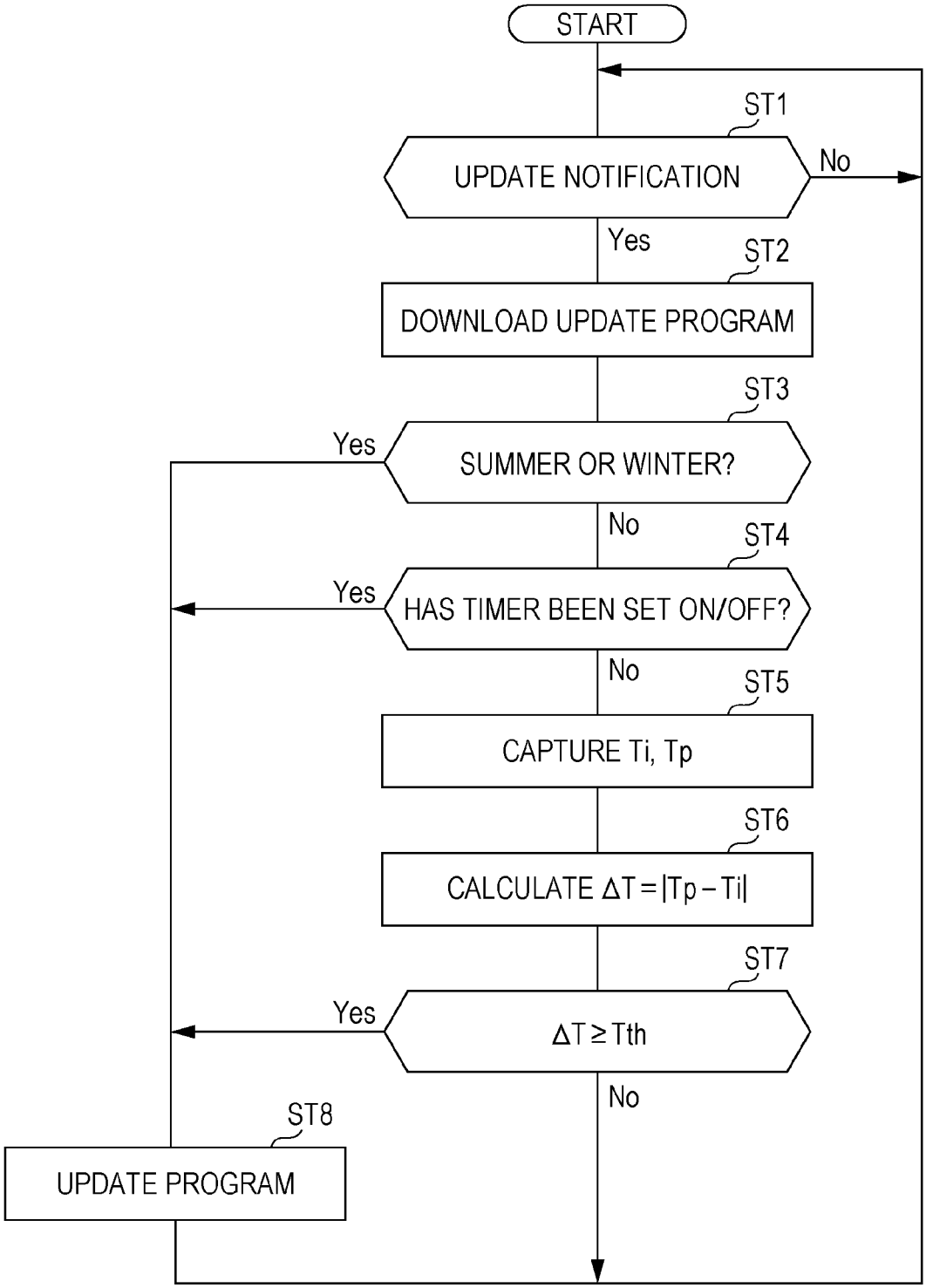
FIG. 3 is a flowchart showing a process when the communication adapter updates a program in another embodiment of the present invention.

Hereinafter, a process performed by the controller 51 when the communication program 52*a* is updated to the update program will be described with reference to FIG. 3. In FIG. 3, ST represents a step of the process. A number following ST represents a number of the step. The room temperature detected by a room temperature sensor (not shown) of the indoor unit 20 is defined as Ti. Then, the set temperature which is a target temperature during operation of the air conditioner determined by operation of the operation terminal 60 by the user is defined as Tp. An absolute value of a value obtained by subtracting the room temperature Ti from the set temperature Tp is defined as the temperature difference ΔT. Further, a threshold temperature difference of the temperature difference ΔT is defined as Tth.

First, the controller 51 determines whether there is a notification of an update of the communication program 52*a*

(ST1). Specifically, when the update program of the communication program 52*a* is uploaded to the external server 70, the controller 51 receives the notification of the update of the communication program 52*a* transmitted from the external server 70 through the communication network 80 and the external communicator 55. The controller 51 determines whether the update notification has been received in a step of ST.

If there is no notification of the update of the communication program 52*a* (ST1-No), the process by the controller 51 returns to ST1. If there is the notification of the update of the communication program 52*a* (ST1-Yes), the controller 51 downloads the update program (ST2). Specifically, the downloader 51*a* of the controller 51 downloads the update program of the communication program 52*a* stored in the external server 70 through the external communicator 55 and the communication network 80, to store the update program in the storage unit 52.

Next, the controller 51 determines whether it is summer or winter (ST3). Specifically, the continuous power supply period determiner 51*c* of the controller 51 determines if it is summer (for example, days between June 1 and September 30) or winter (for example, days between December 1 and March 30), using a calendar (not shown) stored in the storage unit 52 or the calendar information externally obtained through the communication network 80. That is, the continuous power supply period determiner 51*c* determines whether it is the continuous power supply period.

If the current time is summer or winter (ST3-Yes), the controller 51 updates the communication program 52*a* to the update program stored in the storage unit 52 (ST8). Thereafter, the process returns to ST1. Specifically, if the continuous power supply period determiner 51*c* of the controller 51 confirms that it is summer or winter, it is determined that it is in the continuous power supply period. In response to this determination result, the process by the controller 51 proceeds to ST8. Then, the program updater 51*b* of the controller 51 updates the communication program 52*a* to the update program downloaded in ST2 and stored in the storage unit 52.

In summer or winter, cooling operation (or dehumidifying operation) or heating operation is continued in the air conditioner 1 for a long time throughout these periods. In this manner, it is considered that the user does not pull out a power plug of the air conditioner 1 from the outlet while the air conditioner 1 continues an air conditioning operation for a long time. Further, in this period, it is considered that the user does not turn off a breaker for the outlet to which the power plug of the air conditioner 1 is connected. Therefore, even if the communication program 52*a* is updated to the update program in summer and winter, the power supply to the air conditioner 1 is less likely to be interrupted during program update. That is, the power supply to the communication adapter is less likely to be interrupted. Therefore, the update of the communication program 52*a* to the update program can be completed without delay.

In ST3, if it is neither summer nor winter (ST3-No), the controller 51 determines whether the user has set the timer on/off (ST4). Specifically, the continuous power supply period determiner 51*c* of the controller 51 determines whether it has received a signal related to setting of the start and stop of the operation of the air conditioner 1 by the timer from the operation terminal 60 through the operation terminal communicator 53, that is, whether it is in the continuous power supply period.

If the timer on/off is set by the user (ST4-Yes), the process by the controller 51 proceeds to ST8. Then, the communication program 52*a* is updated to the update program stored in the storage unit 52. Thereafter, the process returns to ST1. Specifically, when the continuous power supply period determiner 51*c* of the controller 51 recognizes that the timer on/off is set, it is determined that it is in the continuous power supply period. In response to this determination result, the process by the controller 51 proceeds to ST8. Note that the timer on/off setting by the user is stored in the storage unit 52. The continuous power supply period determiner 51*c* refers to the storage unit 52, to determine whether the timer on/off is set.

The fact that the user has set the timer on/off means that the user intends that the air conditioner 1 automatically starts or stops the air conditioning operation at a time set by the user. Therefore, it is considered that the user does not pull out the power plug of the air conditioner 1 from the outlet. Further, it is considered that the user does not turn off the breaker for the outlet to which the power plug of the air conditioner 1 is connected. Therefore, even if the communication program 52*a* is updated to the update program when the user has set the timer on/off, the power supply to the air conditioner 1 is less likely to be interrupted during the program update. That is, the power supply to the communication adapter is less likely to be interrupted. Therefore, the update of the communication program 52*a* to the update program can be completed without delay.

In ST4, if the timer on/off is not set by the user (ST4-No), the controller 51 captures the room temperature Ti and the set temperature Tp (ST5). Specifically, the controller 51 periodically (for example, every 30 seconds) captures the room temperature Ti from the room temperature sensor (not shown) of the indoor unit 20 and stores it in the storage unit 52 by overwriting. Further, the storage unit 52 captures a latest set temperature Tp determined by the user operating the operation terminal 60, through the operation terminal communicator 53 and stores it by overwriting. The controller 51 captures the set temperature Tp from the storage unit 52.

Next, the controller 51 calculates the temperature difference ΔT using the room temperature Ti and the set temperature Tp that have been captured in ST5 (ST6). Specifically, the continuous power supply period determiner 51*c* of the controller 51 calculates a value obtained by subtracting the room temperature Ti from the set temperature Tp. The absolute value of the calculated value is set to the temperature difference ΔT.

Next, controller 51 determines whether the temperature difference ΔT calculated in ST6 is greater than or equal to a threshold temperature difference Tth (ST7). Specifically, the continuous power supply period determiner 51*c* of the controller 51 determines whether the temperature difference ΔT is greater than or equal to the threshold temperature difference Tth. Here, the threshold temperature difference Tth is predetermined and stored in the storage unit 52. The threshold temperature difference Tth is, for example, 3° C.

If the temperature difference ΔT is greater than or equal to the threshold temperature difference Tth (ST7-Yes), the process by the controller 51 proceeds to ST8. Then, the communication program 52*a* is updated to the update program stored in the storage unit 52. Then, the process returns to ST1. Specifically, if the continuous power supply period determiner 51*c* of the controller 51 determines that the temperature difference ΔT is greater than or equal to the threshold temperature difference Tth, it is determined that it is in the continuous power supply period. In response to this determination result, the controller 51 proceeds to ST8.

When the air conditioner 1 has just started the air conditioning operation, the temperature difference ΔT between the room temperature Ti and the set temperature Tp is large. Further, when the room temperature Ti is rapidly increased or decreased due to opening of a window or door of the room where the indoor unit 20 is installed during the operation of the air conditioner, the temperature difference ΔT between the room temperature Ti and the set temperature Tp increases. As described above, when the temperature difference ΔT is large during the operation of the air conditioner 1, it is considered that the user does not stop the air conditioner 1 and pull out the power plug of the air conditioner 1 from the outlet until the room temperature Ti reaches the set temperature Tp. That is, it is considered that the breaker for the outlet to which the power plug of the air conditioner 1 is connected is not turned off. Therefore, even if the communication program 52*a* is updated to the update program when the temperature difference ΔT is greater than or equal to the threshold temperature difference Tth, the power supply to the air conditioner 1 is less likely to be interrupted during the program update. That is, the power supply to the communication adapter is also less likely to be interrupted. Therefore, the update of the communication program 52*a* to the update program can be completed without delay.

In ST7, if the temperature difference ΔT is not greater than or equal to the threshold temperature difference Tth (ST7-No), the process by the controller 51 returns to ST1. It should be noted that when a season determined in ST3 is summer or winter, when the timer on/off is set in ST4, or when the temperature difference ΔT determined in ST7 is greater than or equal to the threshold temperature difference Tth, it is the continuous power supply period in the present invention.

As described above, after the update program of the communication program 52*a* is downloaded, the communication adapter 50 included in the air conditioner 1 of the present embodiment selects the continuous power supply period in which the power supply to the communication adapter 50 is less likely to be interrupted and updates the communication program 52*a* to the update program. Thus, it is possible to avoid occurrence of a problem due to interruption of the power supply to the communication adapter 50 during the program update. That is, it is possible to avoid that the program is not properly updated due to the interruption of the power supply and that the communication adapter 50 does not operate when the power is supplied again.

In the above description of the embodiment, a case where the communication program 52*a* of the communication adapter 50 is updated is described as an example. However, effects of the present invention are also exhibited when the control program of the indoor unit 20 is updated. Specifically, the controller 51 of the communication adapter 50 receives a signal including the update program of the control program of the indoor unit 20 from the external server 70 through the communication network 80 and the external communicator 54. Then, the controller 51 transmits the obtained signal to the indoor unit controller 21 through the indoor unit communicator 54. Then, the indoor unit controller 21 receiving the signal downloads the update program included in the signal. Thereafter, the indoor unit controller 21 may select the continuous power supply period in which the power supply to the indoor unit 20 is less likely to be interrupted and update the control program to the update program.

In the description of the present embodiment, examples of the continuous power supply period include summer or winter, when the timer on/off is set, and when the temperature difference ΔT is greater than or equal to the threshold temperature difference Tth. However, the continuous power supply period is not limited to this. For example, the continuous power supply period may be the period in which the power supply to the communication adapter 50 is less likely to be interrupted, such as within a predetermined period from the last communication time between the operation terminal 60 and the communication adapter 50 (for example, within 24 hours. It is considered that there is a high possibility that the user operates the air conditioner 1 intermittently within 24 hours from a previous operation).

LIST OF REFERENCE NUMERALS

1: Air conditioner, 20: Indoor unit, 30: Outdoor unit, 50: Communication adapter, 51: Controller, 51*a*: Downloader, 51*b*: Program updater, 51*c*: Continuous power supply period determiner, 52: Storage unit, 52*a*: Communication program, 52*b*: Update control program, 53: Operation terminal communicator, 54: Indoor unit communicator, 55: External communicator, 60: Operation terminal, 70: External server.

The invention claimed is:

1. An air conditioner comprising:

a communication adapter configured to communicate with an external server through a communication network; and a controller that stores in advance a program for controlling the air conditioner or the communication adapter, wherein the controller is configured to download an update program of the program stored in advance from the external server, and determine a continuous power supply period in which supply of operating power to the air conditioner and the communication adapter is less likely to be interrupted, and further update the program stored in advance to the update program in the determined continuous power supply period, and the controller is configured to determine that it is in the continuous power supply period when the controller determines that a temperature difference between room temperature of a room where the indoor unit is installed and a set temperature of operation of the air conditioner is greater than or equal to a predetermined threshold temperature difference.

2. The air conditioner according to claim 1, wherein the communication adapter is mounted on an indoor unit, and is configured to receive supply of the operating power from the indoor unit.

3. An air conditioner comprising:

a communication adapter configured to communicate with an external server through a communication network; and a controller that stores in advance a program for controlling the air conditioner or the communication adapter, wherein the controller is configured to download an update program of the program stored in advance from the external server, and determine a continuous power supply period in which supply of operating power to the air conditioner and the communication adapter is less likely to be interrupted, and further update the program stored in advance to the update program in the determined continuous power supply period, and the controller is configured to recognize that a starting time at which the air conditioner automatically starts or a stopping time at which the air conditioner automatically stops is set by the user, and determine that the starting time and the stopping time is in the continuous power supply period.

* * * * *